United States Patent [19]

Iwako et al.

[11] 4,175,873

[45] Nov. 27, 1979

[54] PROCESS AND APPARATUS FOR MECHANICALLY MIXING TWO IMMISCIBLE LIQUIDS AND ONE OR MORE OTHER SUBSTANCES

[75] Inventors: Hiroyuki Iwako; Shigeki Ando, both of Tokyo, Japan

[73] Assignee: Funken Co., Ltd., Tokyo, Japan

[21] Appl. No.: 949,220

[22] Filed: Oct. 6, 1978

Related U.S. Application Data

[63] Continuation of Ser. No. 819,544, Jul. 27, 1977, abandoned.

[30] Foreign Application Priority Data

Sep. 10, 1976 [JP] Japan ..... 51-107892

[51] Int. Cl.[2] ..... B01F 3/08; B01F 3/12; B01F 7/16; B01F 13/10

[52] U.S. Cl. ..... 366/165; 366/178; 366/290; 366/295; 366/304; 366/305

[58] Field of Search ..... 366/154, 165, 171–174, 366/177, 178, 181, 290, 295, 304, 305, 312

[56] References Cited

U.S. PATENT DOCUMENTS

| | | | |
|---|---|---|---|
| 2,148,998 | 2/1939 | Sackett | 366/165 X |
| 2,306,962 | 12/1942 | Kropp | 366/165 |
| 3,430,925 | 3/1969 | Buhner | 366/172 X |
| 3,871,625 | 3/1975 | Iwako | 366/165 |
| 3,998,433 | 12/1976 | Iwako | 366/178 |

*Primary Examiner*—Philip R. Coe
*Attorney, Agent, or Firm*—Cooper, Dunham, Clark, Griffin & Moran

[57] ABSTRACT

A process and apparatus are disclosed for mechanically mixing two immiscible liquids and one or more other substances by creating in the upper portion of the apparatus a continuous dual-layer liquid film composed of upper and lower layers of immiscible liquids such as oil and water, into which film one or more substances in the gas, liquid, powder, or a combined phase are dispersed and the resulting dispersed mixture is further mixed and emulsified in the lower portion of the apparatus under the action of shearing forces. A portion of the oil to be mixed may be fed directly into the lower portion of the apparatus for mixing with the pre-emulsified mixture.

22 Claims, 3 Drawing Figures

Fig. 1.
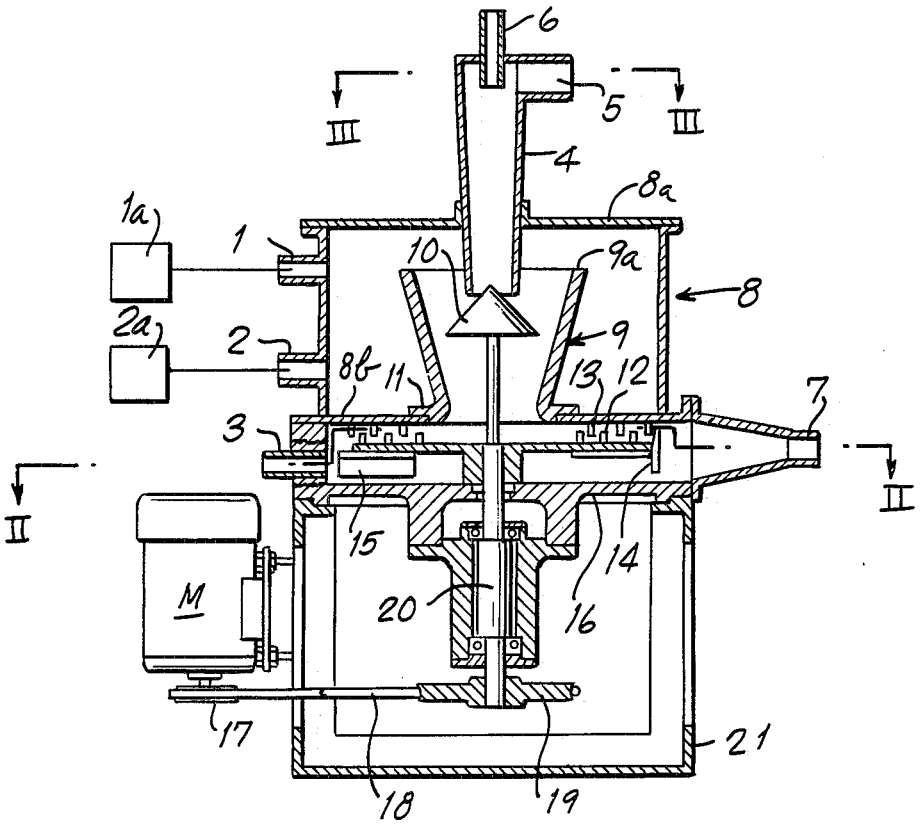
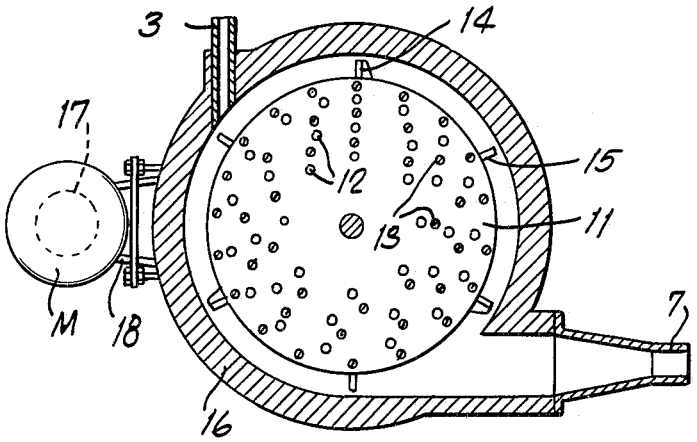
Fig. 2.
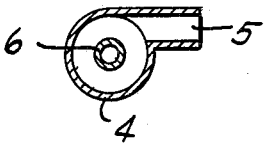
Fig. 3.

PROCESS AND APPARATUS FOR MECHANICALLY MIXING TWO IMMISCIBLE LIQUIDS AND ONE OR MORE OTHER SUBSTANCES

This is a continuation of application Ser. No. 819,544 filed July 27, 1977, and now abandoned.

BACKGROUND OF THE INVENTION

The present invention relates to a process and apparatus for the continuous mechanical mixing of disparate substances, such as oil, water, gas and fine particulate material, in successive steps and ultimately under shearing to produce evenly distributed mixtures of emulsions.

The mixtures produced with the present invention, typically fuel emulsions and colloid fuel in emulsion, have conventionally been produced using emulsification processes requiring an emulsifying agent with attendant chemical reactions and resulting impurities. The present invention, by way of contrast, discloses a process and apparatus which continuously and mechanically produce emulsions and suspensions more simply than, and as effectively as, the prior art while obviating the need for emulsifying agents.

The process and apparatus of the present invention are modifications of and improvements upon those described in U.S. Pat. Nos. 3,871,625 and 3,998,433 issued to one of the co-inventors of the present invention.

SUMMARY OF THE INVENTION

The present invention involves the creation in a suitable apparatus of a dual-layer liquid film, composed of upper and lower layers of immiscible liquids such as oil and water, into which film one or more substances in the gas, liquid, powder, or a combined phase are dispersed, and the resulting dispersed mixture is emulsified by mixing under shearing.

The mixing apparatus comprises an upper mixing section in the form of a cylindrical tank containing a concentrically disposed inverted truncated overflow cone, and a lower section in the form of a mixing or emulsifying chamber containing a mixing disk. A rotatable shaft extending concentrically through the two sections is driven at its lower end and has a mixing cone fixed to its upper end for rotation in the upper portion of the overflow cone. The dual-layer liquid film is created on the inner surface of the overflow cone by introducing a flow of two immiscible liquids, such as oil and water, into the cylindrical tank that overflows the upper rim of the overflow cone. An inlet pipe for the gas, liquid, powder, or combinations to be dispersed into the film is disposed concentrically above the mixing cone and may be adapted to conduct a swirling flow of, for example when producing a fuel, a gas, such as air, premixed with a fine powder or particulate matter, such as coal, for impingement upon the rotating surface of the mixing cone. The impinging material is centrifugally dispersed by the mixing cone into the dual-layer liquid film. The film dispersed with the gas and particulate solids then passes through the lower open end of the overflow cone into the mixing compartment. The mixing disk in the compartment is mounted for rotation on the central portion of the rotary shaft and has circular arrays of upstanding pins on its upper surface which cooperate with similar arrays of pins on the bottom of the stationary cylindrical tank to produce a shearing action on the incoming mixture to mix and emulsify it.

Scraper blades are provided on the lower surface of the mixing disk to further mix and move the resulting emulsion out through an exhaust or delivery port in the side of the mixing compartment. An additional oil inlet may be provided in the mixing compartment to add further oil to the mixture to create a two-step emulsification process between the oil and water.

It is accordingly an object of the present invention to provide a process and apparatus for mechanically mixing two immiscible liquids and one or more other substances.

It is a further object of the present invention to provide a process and apparatus for the continuous mechanical mixing of disparate substances such as oil, water, gas and fine particulate matter.

It is a particular object of the present invention to provide a process and apparatus for producing emulsion fuel and colloid fuel in emulsion without the use of an emulsifying agent.

Other objects, features and advantages of the present invention will be readily appreciated by those skilled in the art upon consideration of the following detailed description taken in connection with the accompanying drawings.

BRIEF DESCRIPTION OF THE DRAWINGS

FIG. 1 is a sectional view in elevation of a continuous flow jet mixer in accordance with the present invention.

FIG. 2 is a sectional view taken along the lines II—II in FIG. 1.

FIG. 3 is a sectional view taken along the lines III—III in FIG. 1.

DETAILED DESCRIPTION OF THE INVENTION

A mixing apparatus in accordance with the present invention is shown in FIG. 1. The upper section of the mixing apparatus comprises an upstanding cylindrical vessel of tank 8 with upper and lower concentrically apertured end walls 8*a*, 8*b* and containing a concentrically arranged inverted truncated overflow cone 9. A feed pipe 4 extends through the aperture or opening in the upper wall 8*a* of tank 8 into the upper portion of overflow cone 9 and acts as a flow chute or inlet for the inflow of gas, liquid, powder or other material in a downward jet. Directly beneath pipe 4 at a level below the upper edge 9*a* of the overflow cone 9 is a spreader cone 10 secured to the upper end of an axially disposed rotary shaft 20. Shaft 20 extends through the lower section of the apparatus and has a pulley 19 on its lower end by means of which it is driven in rotation through a belt 18 and pulley 17 connected to a drive motor M mounted on the mixing apparatus support frame 21. The opening in the lower wall 8*b* of tank 8 communicates the lower portion of overflow cone 9 with the lower section of the apparatus which comprises a cylindrical mixing compartment 16.

The mixing compartment 16 contains a mixing disk 11 which is mounted for rotation with the shaft 20 and has a larger diameter than the opening in the lower wall 8*b* of tank 8, which opening is disposed immediately above it. A plurality of short pins 12 are fixed on the upper surface of the mixing disk 11 in circular arrays and project upwardly into the space between the disk and the lower wall 8*b* of the tank 8. A plurality of similar short pins 13 are fixed on the lower wall 8*b* of tank 8 in circular arrays at different radial spacings from the pins 12 (see FIG. 2) and project downwardly from the lower wall 8*b* to substantially intermesh with the pins 12 in the space above the upper surface of mixing disk 11. Scraper blades 14 and 15 are fixed circumferentially to the underside of the mixing disk 11 for rotation therewith and the mixing compartment 16 is provided with an exhaust or delivery port 7.

In operation, the inlet pipe 4 conducts a flow of one or more substances to be mixed downwardly into the interior of tank 8, which flow impinges upon the upper surface of spreader cone 10. The impinging substance or material is centrifugally dispersed by the rotating cone 10 into the liquid film flowing downwardly on the interior surface of overflow cone 9. The liquid film with the other material dispersed therein then passes into the mixing compartment 16 for subsequent mixing by the shearing action of the mixing disk 11 and its cooperating pin structure. The resulting mixture is then passed, with the help of scraper blades 14 and 15, out through the exhaust or delivery port 7.

It will be seen that the above-described structure and operation incorporates many essential features of the mixing apparatuses disclosed in U.S. Pat. Nos. 3,871,625 and 3,998,433 issued to one of the co-inventors of the present invention.

Unlike the previously-disclosed mixing apparatuses, however, the cylindrical tank 8 of the present invention is provided with two inlets 1 and 2 to permit the continuous feeding of two different immiscible liquids, such as oil and water, each at a constant feed rate into the chamber in the interior of tank 8. Inlets 1 and 2 are preferably tangential so that the two liquids, flowing into the tank chamber tangentially, circulate about the outer surface of the inverted overflow cone 9 and rise in level to the upper edge or rim 9*a* of cone 9. Upon reaching the level of the cone rim, the liquids flow over it and move over the inner surface of the cone 9 in a descending flow creating a continuous liquid film on the inner surface which passes downwardly through the central opening at the base of the cone 9. The form and thickness of the liquid film will be a function of the qualities of the materials to be mixed and can be determined by the skilled artisan using known factors. Similarly, the respective flow rates may be controlled to maintain a continuous film-like flow of the liquids. As the liquids are immiscible, with proper control the film may be formed of two layers. If, for example, oil is fed through inlet 1 and water through inlet 2 at the proper rates, the liquid film will comprise two layers, a layer of water against the inner surface of cone 9, and a layer of oil over the water layer. For best results, individual metering pumps (1*a*, 2*a*) are used to continuously feed the oil or other immiscible liquid through inlet 1 and to feed the water through inlet 2. It will be seen that in order to create and sustain a continuous dual-layer liquid film on the internal surface of the overflow cone 9, the tank 8 is preferably first filled with water to near the rim of the overflow cone 9 prior to the subsequent simultaneous operation of the metering pumps for the water and oil.

Further, in accordance with the present invention, the feed pipe 4 is provided with a plurality of inlets, for example a gas inlet pipe 5, and an inlet pipe 6 for the introduction of particulate matter, typically fine solid powders such as pulverized coal, stabilizer, or the like. The powders may be continuously fed into the induced gas stream, typically air, from inlet 5. The gas-powder mixture will accordingly be fed to the spreader cone 10 through feed chute 4 for subsequent dispersion and mixing into the liquid film flowing downwardly on the inner surface of the overflow cone 9.

The inlet pipe 5 for introducing the gas or air into feed pipe 4 is preferably connected tangentially to pipe 4, as shown in FIG. 3, to provide a circular flow of gas which will tend to mix with the powder or particulate matter introduced from inlet pipe 6. The downward flowing mixture of gas and particles impinges upon the surface of the rotating spreader cone 10 which will impart a centrifugal force to the mixture that may already possess substantial energy by reason of being discharged downwardly in a circulating stream through inlet 4. The kinetic energy of the whirling powder particles aids in their intermixture with and dissolving into the dual-layer liquid film. As the mixture of liquid, gas, and solids descends onto the rotating mixing disk 11, centrifugal force expels the mixture through the pin arrays, 12 and 13, effecting a second phase of intermixture and dissolving. Also in the process the mixture is emulsified by the shearing action of the cooperating pins. The speed of rotation of shaft 20, and thereby of cone 10 and disk 11, may be adjusted to provide optimum mixing and emulsifying actions for the various substances used with the process, as will be understood by those skilled in the art.

A further feature of the present invention involves the incorporation of a secondary oil inlet 3 in the mixing compartment 16 for feeding further oil to the emulsion in the chamber of the mixing compartment. The oil or other immiscible liquid is preferably divided into two supplies to further the emulsification so that a second oil stream is supplied through inlet 3 into the mixing chamber 16. The feed rates of the oil in the two supplies depends on the feed rate of the water, desired emulsion type and other physical and chemical factors as will be familiar to the artisan. With this arrangement the first supply of oil through inlet 1 is emulsified with the water, gas and solids before being mixed with the second supply of oil through inlet 3 and a more stable emulsion is ultimately produced. As a result, the apparatus is able to continuously and mechanically produce an emulsion or emulsified particulate suspension very simply and effectively and without the use of an emulsifying agent, which has been the conventional means for emulsification in the prior art. In the mixing compartment 16 the mixture of liquid, gas and solids is subjected to a shearing force caused by the relative movement of the pins 12 and 13, and the mixture is discharged from the chamber through outlet or delivery port 7 by the action of the scrapers 14 and 15.

EXAMPLE 1

Using the present mixing apparatus an extremely stable emulsion comprising 70 parts oil and 30 parts water by weight with suspended droplets of less than 3 micron diameter has been continuously produced with no emulsifying agent by feeding 30 parts of water through inlet 2 at the rate of 150 kg/hr and appropriate portions of oil through inlets 1 and 3 at the respective rates of 135 and 215 kg/hr. This emulsion remained stable for several months at room temperature.

EXAMPLE 2

Using the mixing apparatus of the present invention a stabilized colloid fuel in emulsion has been continuously produced by feeding 40 parts of oil through inlet 1 at the rate of 180 kg/hr, 20 parts of water through inlet 2 at 90 kg/hr, and 40 parts of pulverized coal through inlet 6 at 180 kg/hr. The coal was continuously dispered into the airflow from inlet 5, which dispersion was subsequently dispersed into the dual-layer liquid film of oil and water. This emulsion also remained stable for several months at room temperature.

Thus, the apparatus and process of the present invention facilitates the mixing and emulsifying of suitable substances in the liquid, gaseous and particulate phases to produce, in appropriate cases, emulsion fuels, or colloid fuels in water-oil type emulsions by using mechanical means obviating the use of emulsifying agents.

We claim:

1. A continuous flow mixer comprising:

tank means having two inlets for respectively receiving two immiscible liquids therein;

means forming an inverted truncated conical surface coaxially disposed within said tank means, and having an upper circumferential rim communicating with the interior of said tank means and a lower open end sealed from the interior of said tank means;

means for feeding two immiscible liquids into said tank means so as to overflow said rim and create a continuous downwardly flowing dual-layer liquid film on said conical surface from said rim to the open lower end;

means for feeding a third substance into said tank means;

means for centrifugally dispersing said third substance into said flowing liquid film on said conical surface;

compartment means communicating with said lower open end for receiving the downwardly flowing dual-layer liquid film containing the third substance dispersed therein; and means in said compartment means for producing a shearing action on the liquids and third substance therein to mix and emulsify the two immiscible liquids and the third substance dispersed therein.

2. A mixer as in claim 1 wherein the means for producing a shearing action comprises two sets of relatively moving operatively intermeshing pin members.

3. A mixer as in claim 1 further comprising means for feeding a liquid directly into said compartment means for mixing with the immiscible liquids and the third substance dispersed therein.

4. A mixer as in claim 1 further comprising means for premixing said third substance with a fourth substance before feeding it into said tank means.

5. A mixer as in claim 1 wherein said two inlets are tangential inlets disposed in the wall of said tank means.

6. A mixer as in claim 1 wherein said liquid feeding means comprises means for feeding the two liquids at constant flow rates.

7. Apparatus for mechanically mixing two immiscible liquids and one or more other substances comprising:

first and second coaxially disposed chambers, said first chamber having two inlets therein;

means for feeding two immiscible liquids into said first chamber respectively through said two inlets;

means for feeding a third substance into said first chamber;

means, comprising a member containing a coaxially disposed inverted truncated conical surface having an upper circumferential rim communicating with said first chamber and a lower open end communicating with said second chamber, for conducting said two liquids, in the form of a continuous dual-layer liquid film flowing over the rim of the open upper end and downwardly over the inverted conical surface of said member, between said first and second chambers;

first rotating means coaxially disposed within said member in the path of flow of said third substance for centrifugally dispersing said third substance into said liquid film;

second rotating means coaxially disposed in said second chamber; and mixing means in said second chamber, including means for rotating with said second rotating means, for producing a shearing action on the liquids and third substance in said second chamber to mix and emulsify the two immiscible liquids and the third substance dispersed therein.

8. Apparatus as in claim 7 wherein said first rotating means comprises a rotating conical surface disposed within the upper portion of said inverted conical surface.

9. Apparatus as in claim 8 wherein said means for rotating with said second rotating means comprises a plurality of upstanding pins fixed on the upper surface of said disk.

10. Apparatus as in claim 9 wherein said mixing means comprises a plurality of stationary pins in said second chamber and operatively intermeshing with said rotating upstanding pins.

11. Apparatus as in claim 7 wherein said second rotating means comprises a rotating disk.

12. Apparatus as in claim 7 wherein said means for feeding a third substance includes premixing means comprising means for producing an axial flow of said third substance and means for producing a circulating flow of a fourth substance in said axially flow.

13. A process for mechanically mixing two immiscible liquids and one or more other substances comprising the steps of:

feeding two immiscible liquids into a first chamber containing an inverted truncated conical surface having an upper circumferential rim communicating with the interior of said tank means and a lower open end sealed from the interior of said tank means;

causing said immiscible liquids to flow over said conical surface rim for creating a continuous downwardly flowing dual-layer liquid film on said surface from said rim to the upper lower end;

feeding a flow of a third substance into said first chamber and centrifugally dispersing said third substance into said downwardly flowing dual layer of liquid film;

receiving the downwardly flowing dual-layer liquid film containing the third substance dispersed therein in a second chamber through the open end of said truncated conical surface; and producing a shearing action on the liquids and third substance in said second chamber to mix and emulsify the two immiscible liquids and the third substance dispersed therein.

14. A process as in claim 13 comprising the further step of feeding liquid directly into said second chamber for mixing with the immiscible liquids and the third substance dispersed therein.

15. A process as in claim 13 wherein the shearing action is produced by two sets of relatively moving operatively intermeshing pin members.

16. A process as in claim 13 wherein said immiscible liquids are oil and water.

17. A process as in claim 13 wherein said third substance is pulverized coal.

18. A process as in claim 13 wherein said third substance is in the form of a powder.

19. A process as in claim 13 further comprising the step of premixing said third substance with a fourth substance before feeding it to said first chamber.

20. A process as in claim 19 wherein said third and fourth substances are mixed by producing a circulating flow of said fourth substance and producing a flow of said third substance axially into said circulating flow.

21. A process as in claim 13 wherein the two immiscible liquids are fed at constant flow rates.

22. A process as in claim 13 wherein said third substance is centrifugally dispersed by axially feeding the flow onto a rotating conical surface.

* * * * *